US007845613B2

(12) United States Patent
Martinez

(10) Patent No.: US 7,845,613 B2
(45) Date of Patent: Dec. 7, 2010

(54) GROUND SECURING ROD

(76) Inventor: Francisco Membrive Martinez, Maria Auxiliadora 214, Terrassa (ES) 08224

( * ) Notice: Subject to any disclaimer, the term of this patent is extended or adjusted under 35 U.S.C. 154(b) by 78 days.

(21) Appl. No.: 12/187,587

(22) Filed: Aug. 7, 2008

(65) Prior Publication Data

US 2010/0032540 A1 Feb. 11, 2010

(51) Int. Cl.
*F16M 13/00* (2006.01)

(52) U.S. Cl. ..... 248/530; 248/508; 135/118

(58) Field of Classification Search ..... 248/507, 248/508, 530, 532; 135/118, 16, 98; 52/155, 52/157, 165, 170
See application file for complete search history.

(56) References Cited

U.S. PATENT DOCUMENTS 2,209,504 A * 7/1940 Better ..... 248/530
4,162,789 A * 7/1979 Hollaway ..... 473/499
5,457,918 A * 10/1995 Plourde ..... 52/165
6,082,157 A * 7/2000 Boyce ..... 70/58
6,321,861 B1 * 11/2001 Leichter ..... 175/323
7,007,910 B1 * 3/2006 Krinner et al. ..... 248/530

* cited by examiner

*Primary Examiner*—A. Joseph Wujciak, III
(74) *Attorney, Agent, or Firm*—Young & Thompson

(57) ABSTRACT

A ground securing rod includes a hollow metal rod (1), whose drive-in end has a flat helical section whose diameter is slightly larger than that of the bar (2), terminating in a tip (3). The section is made with the body of the rod (1) itself by a reduction in its diameter in combination with stamping of the rod in order to flatten it, whereby it is twisted until the helical section is formed, which has a cone-shaped reinforcement at its base (4), while at its upper end the rod (1) has an attached upper reinforcing piece (5), having a seat (6) for a torsion lever (7) that can be inserted into a through opening (8) located at the upper end of the rod and is positioned in the area covered by the upper reinforcing piece (5).

12 Claims, 1 Drawing Sheet

GROUND SECURING ROD

TECHNICAL FIELD

The subject of this invention, as set forth in the preamble to this specification, pertains to a rod whose shape makes it possible to drive it into the ground by hand, without the need for additional tools.

BACKGROUND TO THE INVENTION

This kind of device is often used to secure beach umbrellas and essentially consists of a bar that has a lower end that is designed to be driven into the ground; said bar generally comprises a helical projection that makes it easier to secure it in the sand by twisting the bar while at the same time exerting a small amount of axial pressure thereupon.

Examples of this kind of devices are described in USP 20050211282, USP 20060272687, or USP 20080099061.

The devices are often produced by adding an attached plastic tip to the end of a hollow rod, whereby this tip is produced by injection of plastic. This makes it possible to sell them at very reasonable prices. This design is, however, not very strong.

A different, sturdier design involves soldering on a flanged helical structure along a metal tip that is mounted at the end of a hollow rod. This design is much stronger but at the same time costs more to manufacture, and therefore it is used only in applications that require high quality and performance.

These devices are suitable for securing rods in very soft ground, for example, the sand on a beach, but they are not suitable when the ground is not beach sand, e.g., compacted earth, since the force required to drive them into the ground would greatly exceed the strength of the material and they would certainly break after being driven into the ground a few times. Moreover, their shape has the effect that it is necessary to exert a great deal of thrust and torsion, thus making it impossible to drive them in by hand.

SUMMARY OF THE INVENTION

In order to overcome the above-mentioned disadvantages, a novel kind of ground securing rod has been designed whose structure makes it possible to drive it into both soft sand and into more compact kinds of dirt.

To accomplish this, the novel rod is composed of a hollow metal bar whose drive-in end has a flat helical section whose diameter is slightly larger than that of the bar and is made with the body of the bar itself; this is accomplished by reducing its diameter in combination with stamping it in order to flatten it, whereby it is twisted until the flat helical section is formed that ends preferably in a point.

In turn, said flat helical section, which is made by flattening and twisting a section of the hollow rod of reduced diameter, has at its base a cone-shaped reinforcement that improves the torsional strength of this area.

Moreover, at its upper end the new rod has an attached reinforcing piece that includes a seat for a torsion lever. This seat is formed by one or more protruding U-shaped bodies that are equipped with lateral reinforcements that encompass the lever, clamping it in a position that is parallel to the axis of the rod.

The torsion lever is used by inserting it into a through opening that is located at the upper end of the rod and is positioned in the area that is covered by the upper reinforcing piece, such that the lever runs all the way through the rod, forming with said rod a cross that makes it possible, when implanting the rod, to exert a great deal of torque, as well as powerful axial thrust.

Finally, it should be pointed out that the upper area of the reinforcing piece can be of various shapes that are suitable for adapting the new rod to different uses, for example, it can have a snap-on closure for securing an umbrella, or it can have a hoop for mating with a spring governor or similar part that makes it possible to secure the reins of a harness (mule, horse, etc.) when there is no other natural object suitable for this purpose, or it can also have a ring for attaching a second body, e.g., to use it to secure marker beacons.

DESCRIPTION OF THE DRAWINGS

In order to illustrate what we have stated up to this point, attached to this specification and forming an integral part thereof is a set of drawings that show, in a simplified and schematic manner, a sample embodiment, which is solely a guide and is not intended to be exhaustive, of the characteristics of the novel invention.

This example shows a typical design for securing an umbrella.

DETAILED DESCRIPTION OF THE INVENTION

Figure 1:
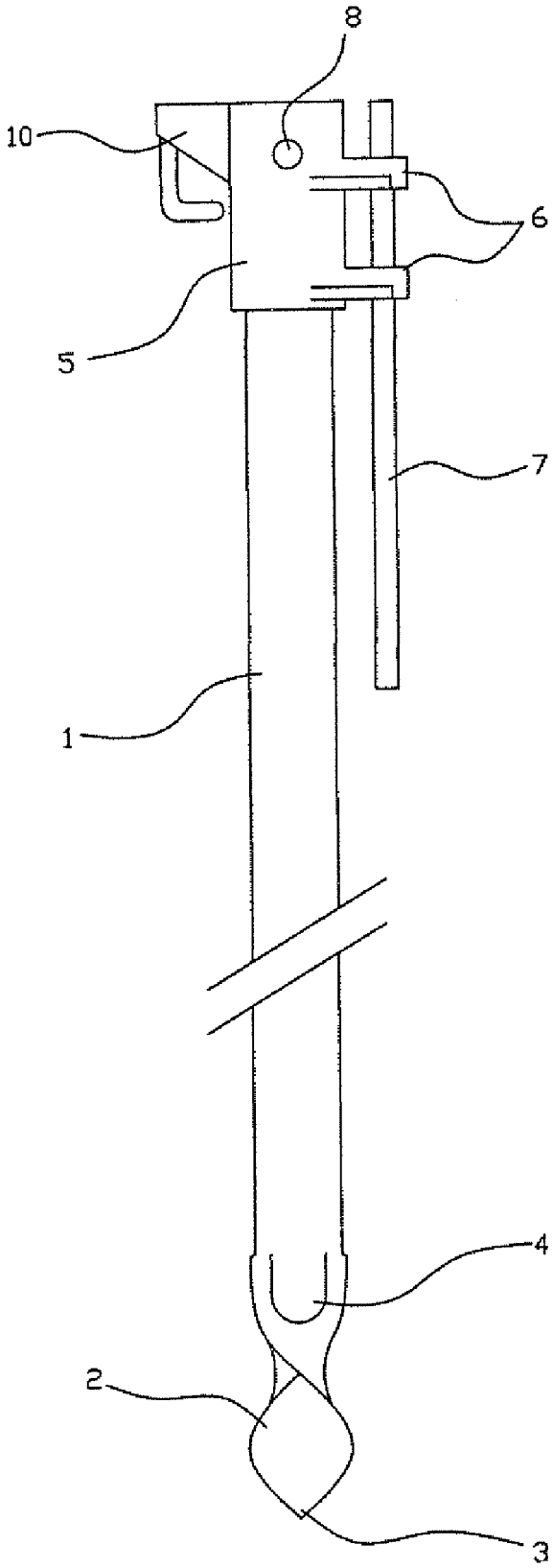
FIG. 1 shows an elevation view of the novel rod.
Figure 3:
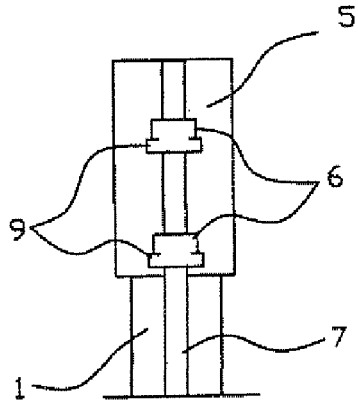
FIG. 3 shows a detailed view of the reinforcement of the torsion lever seat.
Figure 2:
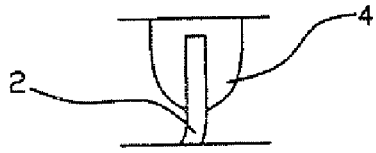
FIG. 2 shows a detailed view of the lower cone-shaped reinforcement.

The novel ground securing rod is composed of a hollow metal rod (1), whose drive-in end has a flat helical section (2) whose diameter is slightly larger than that of the bar, terminating in a tip (3), whereby said section is made with the body of the rod (1) itself, which comprises a cone-shaped reinforcement at its base (4), while at its upper end the rod (1) has an attached upper reinforcing piece (5), which comprises a seat (6) for a torsion lever (7) that can be inserted into a through opening (8) that is located at the upper end of the rod and is positioned in the area covered by the upper reinforcing piece (5).

Said seat (6) is formed by one or more U-shaped protruding bodies that are equipped with lateral reinforcements (9) that encompass the torsion lever (7), clamping it in a position that is parallel to the axis of the rod (1).

According to the illustrative example, the upper reinforcing piece (5) has a snap-on closure (10) for attaching an umbrella.

As far as the subject of the invention is concerned, it does not matter what materials are used in the manufacture of the parts that make it up, nor do the shapes, dimensions, and accessories that it may have matter since they can be replaced by others that are technically equivalent, provided that they do not affect the essence of the subject of the invention and do not exceed the scope defined in the Claims section.

Now that the concept has been established, below are presented the Claims, which summarize the novel aspects that are to be claimed:

The invention claimed is:

1. A ground securing rod for supporting an umbrella having a shaft, consisting of:

a hollow metal rod (1) having an upper end and a base end, whose drive-in end has a flat helical section whose diameter is slightly larger than the rod (2), terminating in a tip (3) below the base end of rod, whereby the section is made with a body of the rod (1) itself by means of a reduction in its diameter in combination with stamping of the rod in order to flatten the rod, whereby the rod is twisted until the helical section is formed, which comprises a cone-shaped reinforcement at the base end (4) of rod, while at its upper end the rod (1) has an attached upper reinforcing piece (5), which comprises a seat (6) extending outwardly from the reinforcing piece for a torsion lever (7) that can be inserted into a through opening (8) that is located at the upper end of the rod and is positioned in an area covered by the upper reinforcing piece (5), whereby the shaft of the umbrella extends through the opening of the reinforcing piece and hollow rod.

2. The ground securing rod in accordance with claim 1, wherein the seat is formed by one or more U-shaped protruding bodies that are equipped with lateral reinforcements (9) that encompass the torsion lever (7), clamping it in a position that is parallel to the axis of the rod (1).

3. The ground securing rod in accordance with claim 1, wherein an upper area of the reinforcing piece (5) is of variable shape so that the rod can be adapted to different uses.

4. The ground securing rod in accordance with claim 1, wherein an upper area of the reinforcing piece (5) has a snap-on closure (10) for securing an umbrella.

5. The ground securing rod in accordance with claim 1, wherein an upper area of the reinforcing piece (5) has a hoop.

6. The ground securing rod in accordance with claim 1, wherein an upper area of the reinforcing piece (5) has a ring for attaching a second body.

7. The ground securing rod in accordance with claim 1, wherein an upper area of the reinforcing piece (5) has a ring for attaching a second body.

8. A ground securing rod for supporting an umbrella having a shaft, comprising:

a hollow metal rod (1) having an upper end and a base end, whose drive-in end has a flat helical section whose diameter is slightly larger than the rod (2), terminating in a tip (3) below the base end of rod, whereby the section is made with a body of the rod (1) itself by means of a reduction in its diameter in combination with stamping of the rod in order to flatten the rod, whereby the rod is twisted until the helical section is formed, which comprises a cone-shaped reinforcement at the base end (4) of rod, while at its upper end the rod (1) has an attached upper reinforcing piece (5), which comprises a seat (6) extending outwardly from the reinforcing piece for a torsion lever (7) that can be inserted into a through opening (8) that is located at the upper end of the rod and is positioned in an area covered by the upper reinforcing piece (5), whereby the shaft of the umbrella extends through the opening of the reinforcing piece and hollow rod.

9. The ground securing rod in accordance with claim 8, wherein the seat is formed by one or more U-shaped protruding bodies that are equipped with lateral reinforcements (9) that encompass the torsion lever (7), clamping it in a position that is parallel to the axis of the rod (1).

10. The ground securing rod in accordance with claim 8, wherein an upper area of the reinforcing piece (5) is of variable shape so that the rod can be adapted to different uses.

11. The ground securing rod in accordance with claim 8, wherein an upper area of the reinforcing piece (5) has a snap-on closure (10) for securing an umbrella.

12. The ground securing rod in accordance with claim 8, wherein an upper area of the reinforcing piece (5) has a hoop.

* * * * *